United States Patent [19]

Livens et al.

[11] Patent Number: 4,487,596

[45] Date of Patent: Dec. 11, 1984

[54] METHOD OF, AND APPARATUS FOR, MANUFACTURING A FLIP-TOP BOX

[75] Inventors: Michael G. Livens, Harlow; James E. Adams, Billericay, both of England

[73] Assignee: Wilkinson Sword Limited, England

[21] Appl. No.: 337,632

[22] Filed: Jan. 7, 1982

[30] Foreign Application Priority Data

Jan. 16, 1981 [GB] United Kingdom ..... 8101398
Jun. 25, 1981 [GB] United Kingdom ..... 8119630

[51] Int. Cl.[3] ..... B31B 3/74; B31B 7/26

[52] U.S. Cl. ..... 493/125; 493/143; 493/173; 493/169; 493/911

[58] Field of Search ..... 493/123, 125, 126, 143, 493/167, 169, 172, 173, 174, 319, 910, 911

[56] References Cited

U.S. PATENT DOCUMENTS 4,197,789 4/1980 Moen ..... 493/167 X
4,392,338 7/1983 Fox ..... 493/911 X

FOREIGN PATENT DOCUMENTS 715120 11/1931 France ..... 493/173
2254493 10/1974 France .
384322 11/1932 United Kingdom ..... 493/172
819204 9/1959 United Kingdom .

*Primary Examiner*—Rodney H. Bonck
*Assistant Examiner*—James J. Merek
*Attorney, Agent, or Firm*—John K. Williamson

[57] ABSTRACT

A flip-top box is folded from a one-piece skillet by bringing a contents retainer panel (R) into overlapping relationship with a front panel ($C_1$); thereafter pressing the skillet into a rectangular opening of a die (70), to cause certain panels of the skillet to stand perpendicular to rear panels of the container and lid, folding portions of the skillet projecting from the die into a plane parallel spaced from the rear panel and causing other portions to enter the die; and pressing the partially folded skillet into a rectangular opening of a second die opposite the first die to fold down the outside panels of the box to complete the box formation.

10 Claims, 27 Drawing Figures

METHOD OF, AND APPARATUS FOR, MANUFACTURING A FLIP-TOP BOX

BACKGROUND OF THE INVENTION

This invention relates to a method of, and apparatus for, manufacturing hinged-lid boxes of the type frequently called flip-top boxes, suitable for containing matches, cigarettes, pharmaceutical tablets or pills, and other goods. The invention also relates to a flip-top box made by the aforementioned method.

The so-called "flip-top" box is a well known package used widely for containing cigarettes and characterised by a container section having front, back, bottom and side panels, and a flip-top hinged lid having front, back, top and side panels. The back panel of the lid forms an integral extension of the back panel of the container section and contains a crease line to define a hinge axis. The sides of the lid taper from the front panel to the back panel of the lid, and the sides of the container section taper in a complementary manner so that when the lid is flipped open, the goods are displayed.

In order to support the lid on the container section in the closed state, a three-sided contents retainer is fitted around the inside of the front and side panels of the container section with a cut-away in the forward facing portion of the retainer through which the contents of the box can be seen. The front panel and side supports of the retainer thus project above the upper edge of the container section and are overlapped by the front and side panels of the flip-top lid when it is closed. Although reference has been made to a 'container section', the goods do in fact extend into the lid when the lid is closed.

This type of box has numerous advantages. In particular, since movement of the lid from an open to a closed position and vice versa involves a momentary resilient deformation of one or more parts of the container section, there is a substantial resistance to opening of the lid from the closed position. Moreover, the three layer construction of the sides of the box give it considerable crush resistance.

Hitherto, the use of this box construction has been limited to cigarette packing, and in this application, a collection of ten or twenty cigarettes are assembled, wrapped in foil, placed on a skillet from which the box is to be formed, a retainer is fitted over the cigarettes and the flip-top box is erected around the cigarettes by folding of the skillet. The box so formed does not require a high degree of durability since it will be discarded once the contents are used up and this will frequently involve a life of a few days or less.

Proposals have been made, for example in British Patent Specification No. 819204 and French Patent Specification No. 2,254,493 to provide a skillet, for the manufacture of cigarette packets, which has been formed in one piece, the retainer being connected to the front panel of the box by a connecting panel. The retainer is thus brought into overlapping relationship and secured to the front panel by folding along the fold lines at opposite ends of the connecting panel and causing the connecting panel to adhere to the front panel and retainer.

The way in which such a one-piece skillet is thereafter folded has not been disclosed, but it can be assumed that it is folded, by conventional cigarette packing techniques, around the assembly of cigarettes.

If however a flip top box could be made accurately and durably in a form in which it could be filled with its contents after completion of its construction, it would have wide application, and the present invention is directed to the solution of this problem.

BRIEF SUMMARY OF THE INVENTION

According to the present invention there is provided a method of folding a one-piece skillet to form a flip-top box, the skillet having crease lines to define a main panel to form the back of the container and lid of the box, left and right, inside and outside panels, to form the left and right sides of the container, left and right inside and outside panels for the lid, front and retainer panels, a bottom panel for the container and a top panel and front panel for the lid, certain of the said panels having flaps attached thereto, which method is characterised by the steps of pressing the skillet into a rectangular opening of a first die shaped to fit said main panel to cause the adjacent said left and right inside panels and top and bottom panels attached thereto to be bent into planes perpendicular to said main panel and thereafter, while the skillet is retained in the die opening, folding the front container panel and front lid panel into parallel relationship with the main panel and, after the application of adhesive to the outside panels of the container and of the lid, pressing the partially-formed box from the first die into a second die in which the said outside panels are folded down and adhered in position to complete the closed box construction.

The present invention also provides apparatus for folding a one-piece skillet to form a flip-top box, said apparatus comprising a first die into which the skillet can be pressed to bring parts of the skillet perpendicular to a back panel of the finished container and lid of the box characterised by means for bending parts of the skillet which project from the die into a plane parallel to said back panel, and a second die disposed opposite the first die and having therein a slightly larger opening than that of the first die into which the box, after partial formation in the first die, can be pressed to fold down parts of the skillet which form outside panels of the finished box.

The use of a die into which a carton blank is pressed by a plunger in order to set up the sides of a carton is, of course, known in conventional carton forming machinery, as for example is described in British Patent Specification No. 898364.

Cigarette packets are commonly made from cardboard of 300 microns thickness, but for a durable fillable box a greater thickness of board, e.g. up to 500microns, is preferable. The method and apparatus according to the invention are intended to be used for folding boxes from board within a range of thicknesses possibly as wide as 300–500 microns.

BRIEF DESCRIPTION OF THE DRAWINGS

One form of a flip-top box, a skillet from which it can be folded, and apparatus for folding the box, in accordance with the invention, will now be described with reference to the accompanying drawings in which.

DETAILED DESCRIPTION

Figure 1:
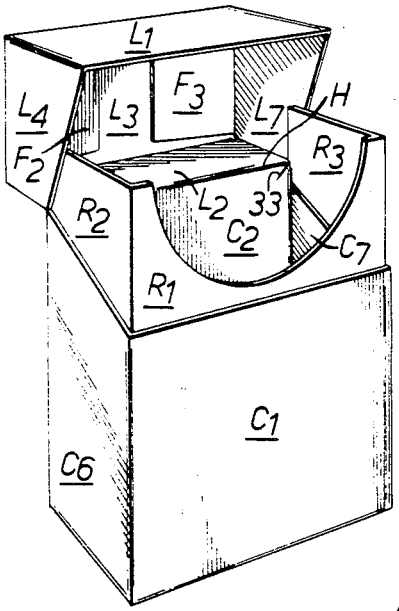
FIG. 1 is a perspective view of the erected flip-top box.
Figure 2:
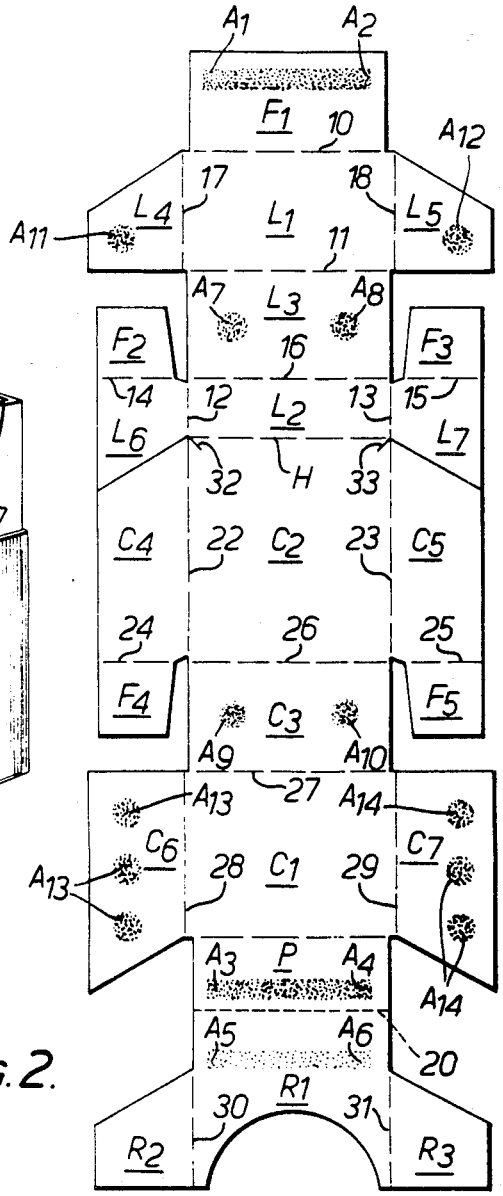
FIG. 2 is a plan view of a one piece skillet from which the box of FIG. 1 has been folded.
Figure 2A:
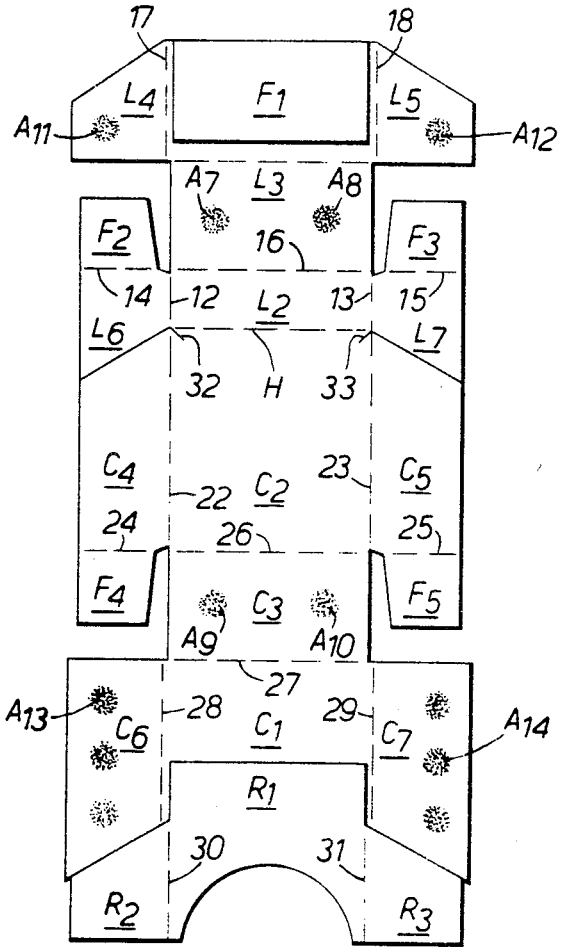
FIG. 2A showing the skillet after folding of its opposite end portions.

As shown in FIGS. 1 and 2, the flip-top box has a lid which comprises front panel $L_1$, back panel $L_2$, top panel $L_3$ and outer side panels $L_4$,$L_5$ whereas the container section has a front panel $C_1$, a back panel $C_2$, a bottom panel $C_3$, inner side panels $C_4$,$C_5$ and outer side panels $C_6$, $C_7$. The retainer comprises an inner front panel $R_1$ and side support panels $R_2$,$R_3$.

In order to interconnect the outer panels of the box in their final configuration, flaps and inner panels are provided which are folded inwardly and adhered to the outer panels to strengthen them and/or provide support for the outer panels.

Thus, as seen in FIG. 2, a lid locking/reinforcing flap $F_1$ is provided at one end of panel $L_1$ to strengthen this panel; lid inner flaps $F_2$,$F_3$ are also provided to strengthen panel $L_1$ and lid inner side panels $L_6$,$L_7$ are provided to strengthen outer side panels $L_4$,$L_5$.

In the container section, inner side panels $C_4$,$C_5$ alongside opposite sides of panel $C_2$ are provided to strengthen container outer side panels $C_6$,$C_7$ and flaps $F_4$,$F_5$ are provided at the lower ends of $C_4$,$C_5$ to give support to the bottom panel $C_3$.

A retainer linking panel P is provided between panel $C_1$ and retainer inner front panel $R_1$ for a purpose which will be described below. The various flaps and panels are connected together along crease lines as illustrated in FIG. 2. The skillet also contains two slits 32,33 at the top of the back panel $C_2$ to allow the top of the back panel to flex as the lid is opened or closed and provide, at least in part, the spring force which has to be overcome as the flip top is opened and closed.

Broadly the method of folding the box is as follows.

In an initial operation, adhesive is applied at and between the positions $A_1$,$A_2$ on panel $F_1$, between $A_3$,$A_4$ on panel P, and between positions $A_5$, $A_6$ on the outer face of panel $R_1$. Panel $F_1$ is then folded through 180° onto panel $L_1$, and panel P is folded through 180° onto panel $C_1$, at the same time panel $R_1$ being folded backwards through 180° as it is superimposed on panel P.

For the next stages of folding, adhesive is applied in positions $A_7$, $A_8$ on panel $L_3$ and $A_9$, $A_{10}$ on panel $C_3$, at $A_{11}$, $A_{12}$ on flaps $L_4$, $L_5$, and at $A_{13}$, $A_{14}$ on panels $C_6$ and $C_7$. In the next stage of folding, flaps $F_2$ and $F_3$, as well as $F_4$, $F_5$, are bent upwardly into a position substantially perpendicular to panel $C_2$ and immediately thereafter panels $L_6$, $L_7$, and $C_4$, $C_5$ are bent through 90° to stand perpendicular to panel $C_2$.

As the bending of panels $C_4$, $L_6$, and parts attached thereto, takes place about foldlines 12, 22, and the folding of panel $C_5$,$L_7$, and parts attached thereto, takes place about foldline 13,23, panel $L_3$ and parts attached thereto is folded about foldline 16, and panel $C_3$, and parts attached thereto, is folded about foldline 26. This folding takes place until all the parts folded about the lines 12, 13, 14, 15, 16, 24, 25, 26 stand perpendicular to panel $C_2$ and are held in this position when the adhesive has set.

In the next stage of folding the box, panel $C_1$ is folded about foldline 27, and as this progresses, panels $R_2$ and $R_3$ are folded about foldlines 30,31 to bring panels $R_2$,$R_3$ inside the upright panels $C_4$,$C_5$. In the same stage of operation, panels $L_1$ and $F_1$ which are adhered to each other, are folded about crease line 11 until they overlie the arcuate end of panel $R_1$, and the panels $F_1$,$L_1$,$R_1$,$C_1$ now lie parallel-spaced from panel $C_2$.

In a final stage of folding the box, the panels $C_6$,$C_7$ and $L_4$,$L_5$ coated with adhesive on their underside are then folded through 90° about foldlines 28,29,17,18 respectively into abutment with the outer sides of panels $C_4$,$C_5$,$L_6$,$L_7$ on which the respective panels will adhere to complete the erection of the box.

After erection of the box, the box will be opened to receive a charge of contents. In the case of matches or cigarettes these will be assembled and charged into the container in a single operation.

Apparatus for carrying out the method referred to above will now be described.

A conveyor 40 formed by spaced conveyor chains 41, passing over sprocket wheels 42 and carrying locating lugs 43 for engaging the rear two corners of a one-piece skillet 44 passes under a feed device 45 at a skillet feeding station 46. (see FIGS. 3 and 4).

Suction cups 47 are movable upwardly below a stack 48 of skillets to engage the lowermost skillet of the stack and to move it downwardly into engagement with the lugs. The skillets are housed in a container (not shown) whose outlet is of a size slightly smaller than that of a skillet so that some force is required to extract the lowermost skillet from the container. The suction, and release of suction, in the cups are synchronised with the movement of the suction cups and of the conveyor chains.

A conveyor belt 50 downstream of the feeding station 46 receives the skillets, in spaced apart relationship, from the chain conveyor. The skillets are pressed on to the belt 50 by rollers 51 mounted in a carrier 52 fixed above the belt. The rollers serve to increase the frictional force between the skillets and the belt and ensure that the skillets do not slide on the belt.

Figure 5:
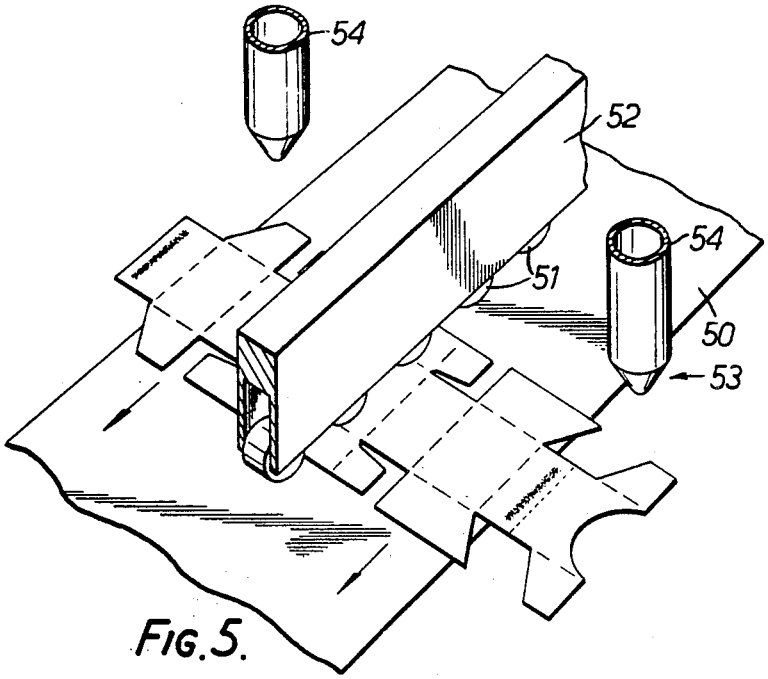
FIGS. 5 and 6 are diagrammatic perspective views of two separate gluing stations.
Figure 6:
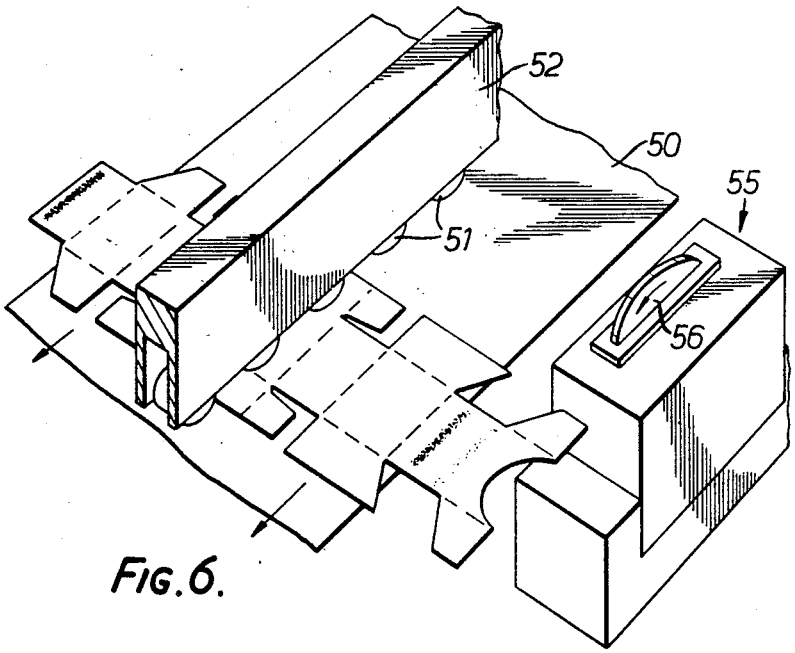

The belt conveys the skillet through a first gluing station 53 in which glue ejection nozzles 54 spray liquid glue on to the inner face of panels $F_1$ and P of the skillet (see FIGS. 2 and 5) and through a second gluing station 55 (see FIG. 6) in which a glue application roller 56 applies liquid glue to the outer face of panel $R_1$ which overlaps panel P.

Figure 3:
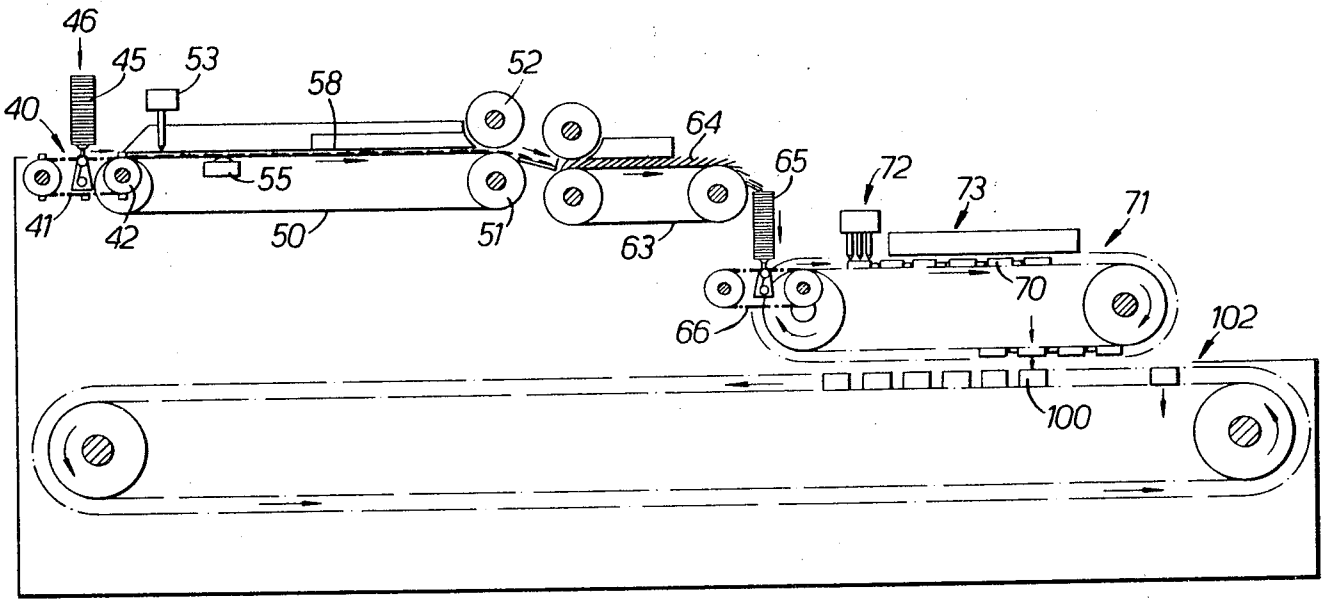
FIG. 3 is a diagrammatic side elevation of a system for feeding one-piece skillets on to a conveyor and for transporting the skillets through stations in which they are glued, folded and pressed to form flip-top boxes.
Figure 4:
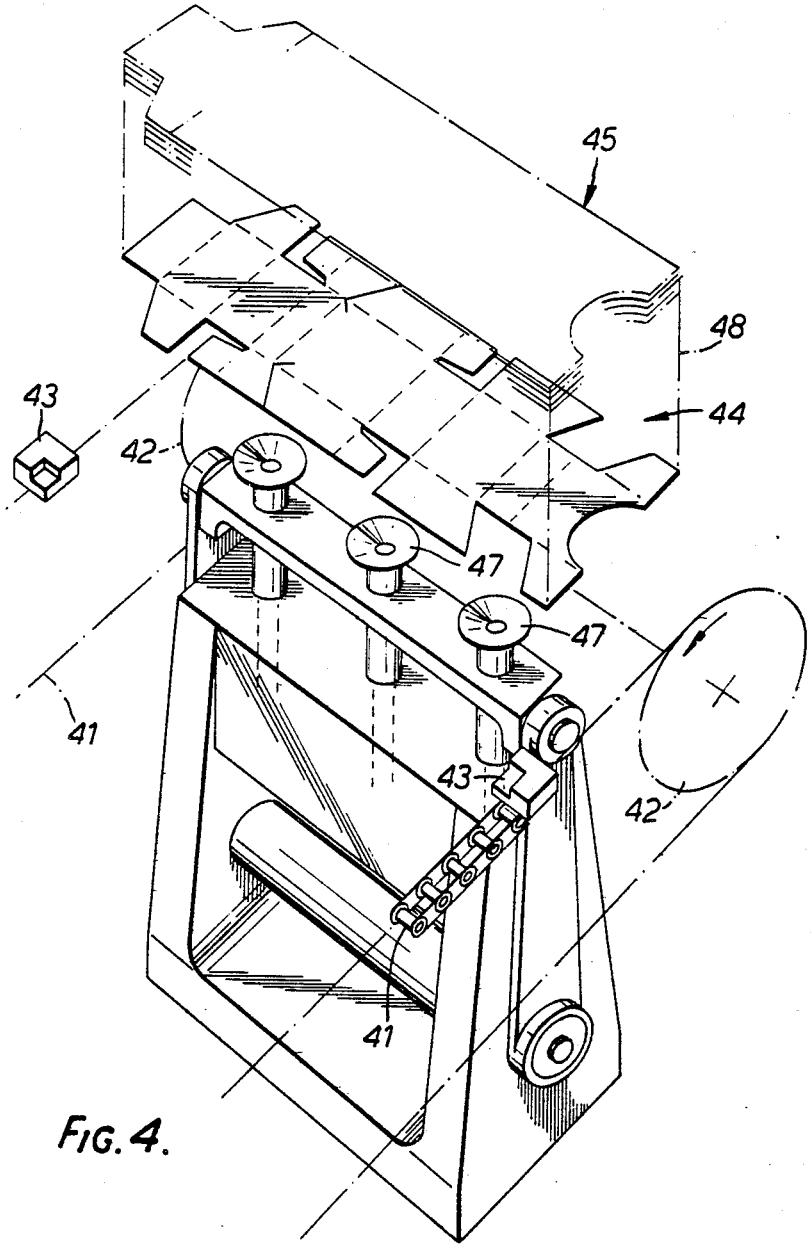
FIG. 4 is a diagrammatic perspective view of apparatus at a feeding station forming part of the system of FIG. 3.
Figure 7:
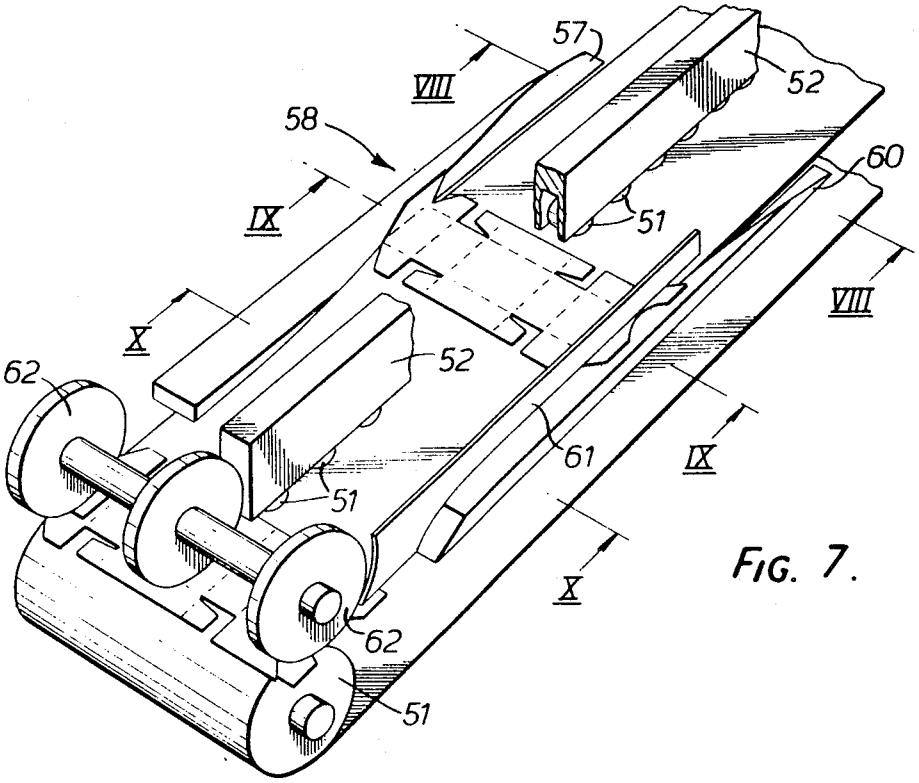
FIG. 7 is a diagrammatic perspective view of apparatus for folding opposite end portions of the skillet.
Figure 8:
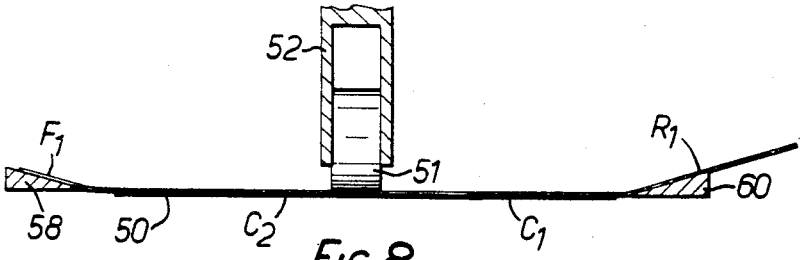
FIGS. 8 to 10 are sections on the lines VIII—VIII to X—X of FIG. 7.
Figure 9:
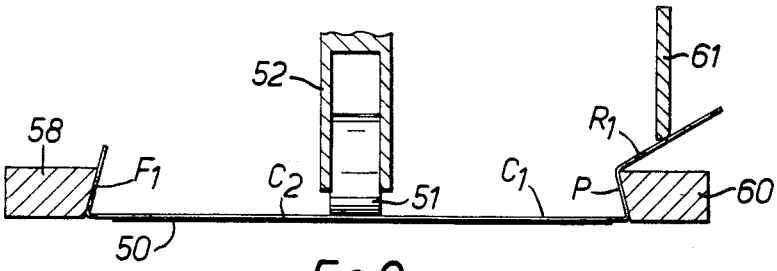
Figure 10:
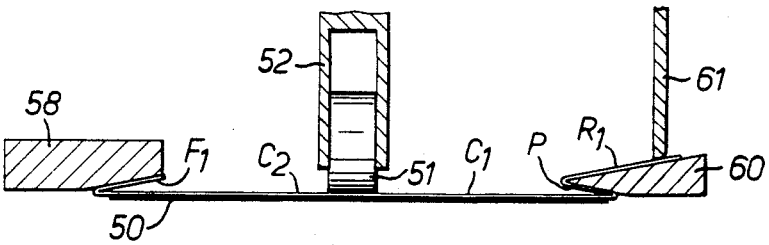

At a first folding station 58 illustrated in FIGS. 3 and 7, folding guides 57, 60, 61 are located along opposite sides of the conveyor and define a guide path for folding the opposite end portions of the skillet as illustrated in the sectional views of FIGS. 8 to 10. At the outlet of station 55, the skillets pass between a conveyor belt roller 51 and upper pressing rollers 62 to press the folded end portions.

Figure 11:
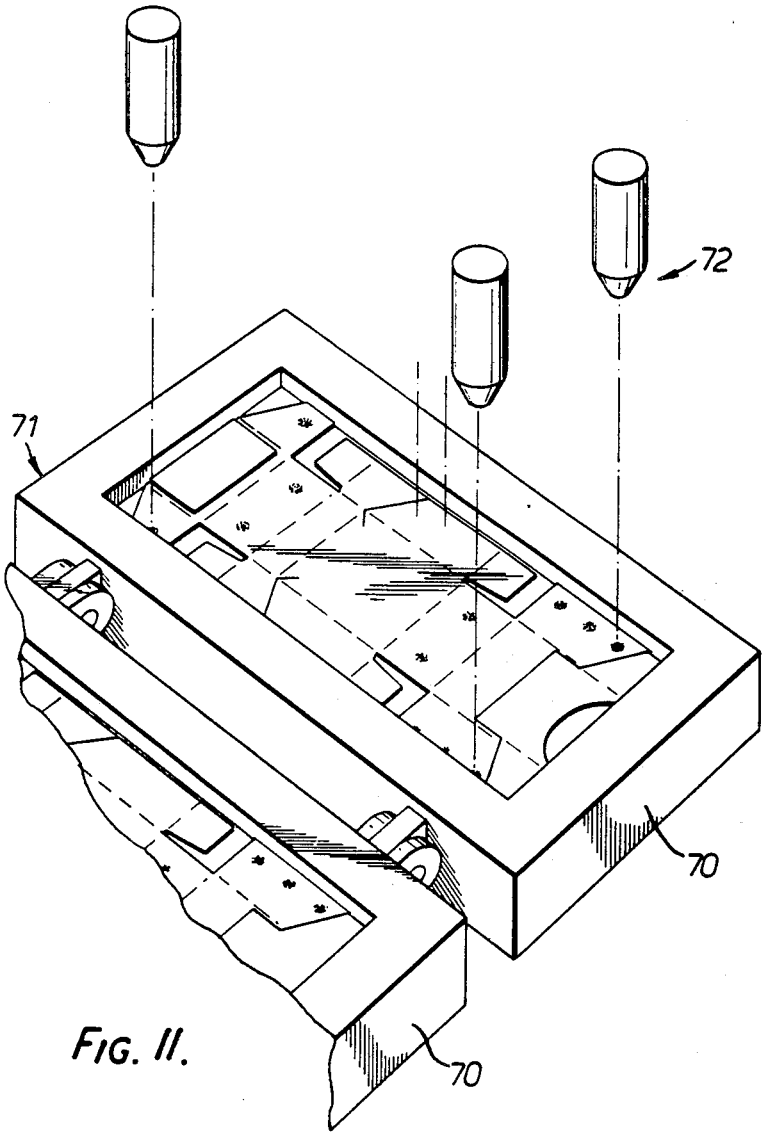
FIG. 11 is a diagrammatic perspective view of erecting dies pivotally interconnected to form a conveyor, and in each of which a partially-folded skillet is received.

The skillets fed from the first folding station are gathered on a belt conveyor 63, which is the third conveyor, into a horizontally extending stack 64 and fed from the second belt conveyor into a second feed device 65, similar to the feed device 45. From the feed device 65, the partially folded skillets are fed downwardly on to a fourth conveyor 66 and thence into a pivotally-interconnected series of dies 70 which form a fifth conveyor 71 as shown in FIGS. 3 and 11. This fifth conveyor 71 which can be operated in a continuous manner, or in a step-by-step manner, transports the skillets individually from the feed device 65 and fourth conveyor via a gluing station 72 illustrated in FIGS. 3 and 11 to an erecting station 73 illustrated in FIGS. 12 to 22.

Figure 12:
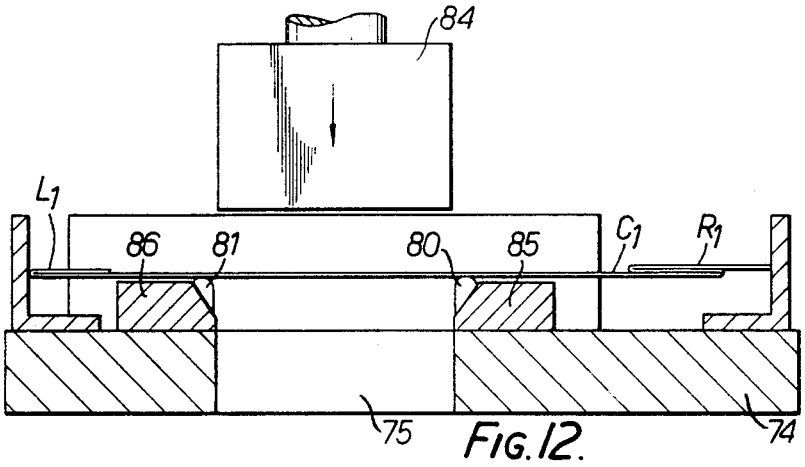
FIGS. 12, 13 and 14 are sections through a die as shown in FIG. 11 and showing a plunger moving into the die cavity to erect the sides and ends of the box.
Figure 13:
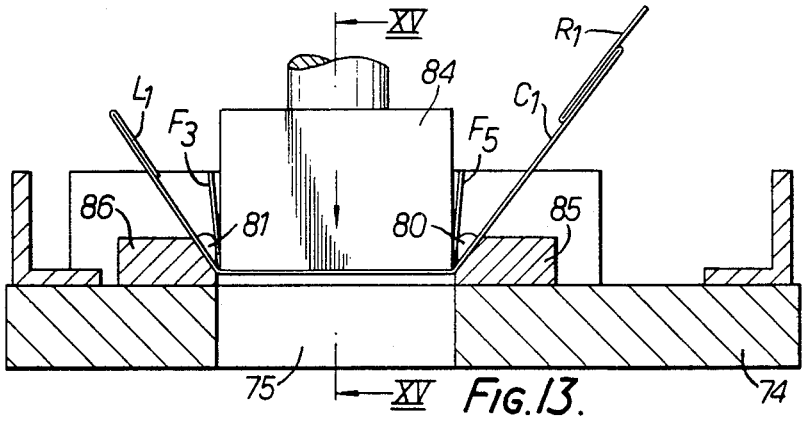
Figure 14:
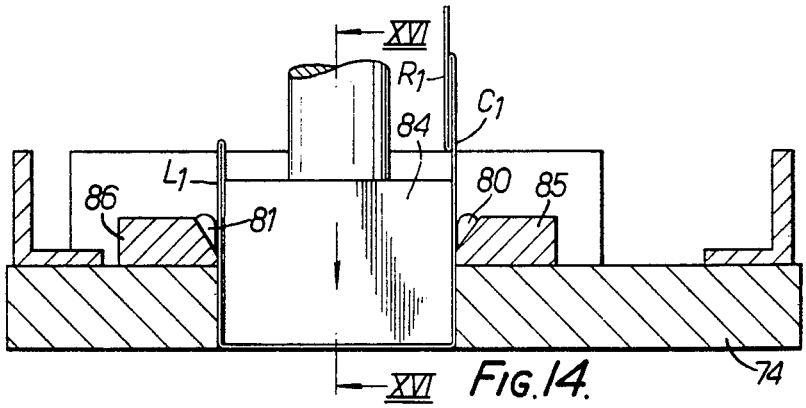
Figure 15:
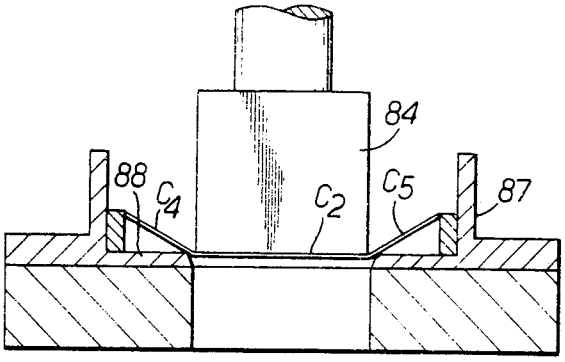
FIGS. 15 and 16 are sections on the line XV—XV of FIG. 13 and XVI—XVI of FIG. 14.
Figure 16:
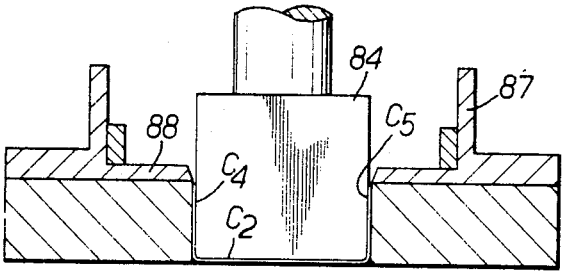
Figure 17:
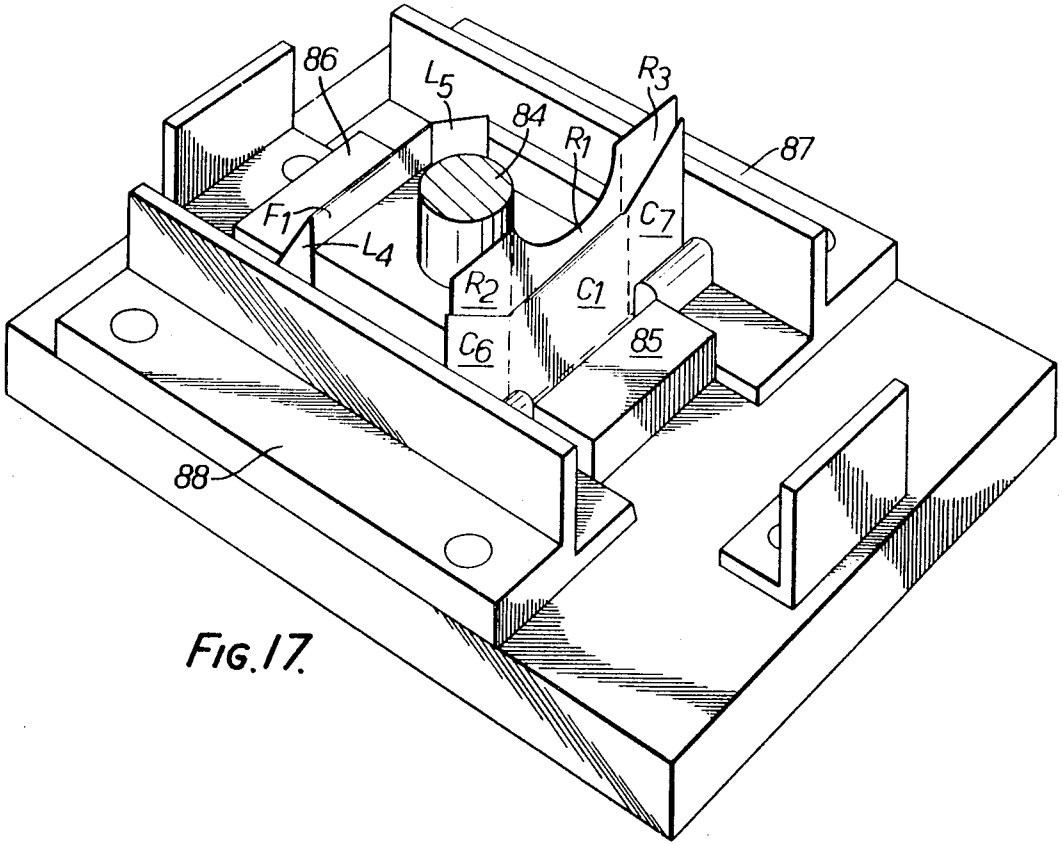
FIG. 17 is a diagrammatic perspective view of the die of FIGS. 12 to 16 showing an erected box.

As shown in FIG. 12, the die 70 is in the form of a plate 74 having a rectangular opening 75 therein shaped to receive panels $C_2$, $L_2$. Located around the die opening are four posts (two only of which are shown at 80, 81) upstanding from the upper surface of the erecting die and located in positions to bend the flaps $F_2$,$F_3$,$F_4$ and $F_5$ substantially perpendicular to panel $C_2$. In addition, a plunger 84 is provided which is mounted for movement in a direction perpendicular to the plane of the erecting die into and out of the opening.

When the skillet is located below the plunger 84, the plunger 84 is brought down to engage panel $C_2$, pressing the skillet down onto the upright posts to fold flaps $F_2$,$F_3$,$F_4$,$F_5$ upwardly.

Mounted on the upper surface of the erecting die between the posts (such as 80,81) are guides or formers (85–88) having sloping surfaces which terminate at their lowermost edge at or close to the edges of the die opening. Consequently, as the plunger pushes the skillet downwardly, these formers commence the folding of the panels $C_4$,$L_6$; $C_5$,$L_7$; $C_3$,$L_3$, which panels will thereafter be pressed against the sides of the plunger as the plunger enters the die opening or well 75.

The formers 87, 88 which served to fold the panels $C_4$, $C_5$, $L_6$ and $L_7$, are spring-loaded toward the plunger 84 so that when the plunger has fully entered the die opening, the outer edges of panels $C_4$, $C_5$, $L_6$ and $L_7$ will move below the level of the formers 87,88 and allow these formers to snap inwardly under their biasing springs until they engage the sides of the plunger. In this way, when the plunger is withdrawn from the die opening, the folded skillet will be held in position by the formers which overlap the edges of panels $C_4$,$C_5$, $L_6$, $L_7$ and act as strippers.

The next stage of folding takes place while the skillet is held in the same erecting die, and is illustrated in FIGS. 18 to 22. Several of the parts illustrated in FIGS. 18 to 22 have been omitted from FIG. 17 in the interest of clarity.

Figure 18:
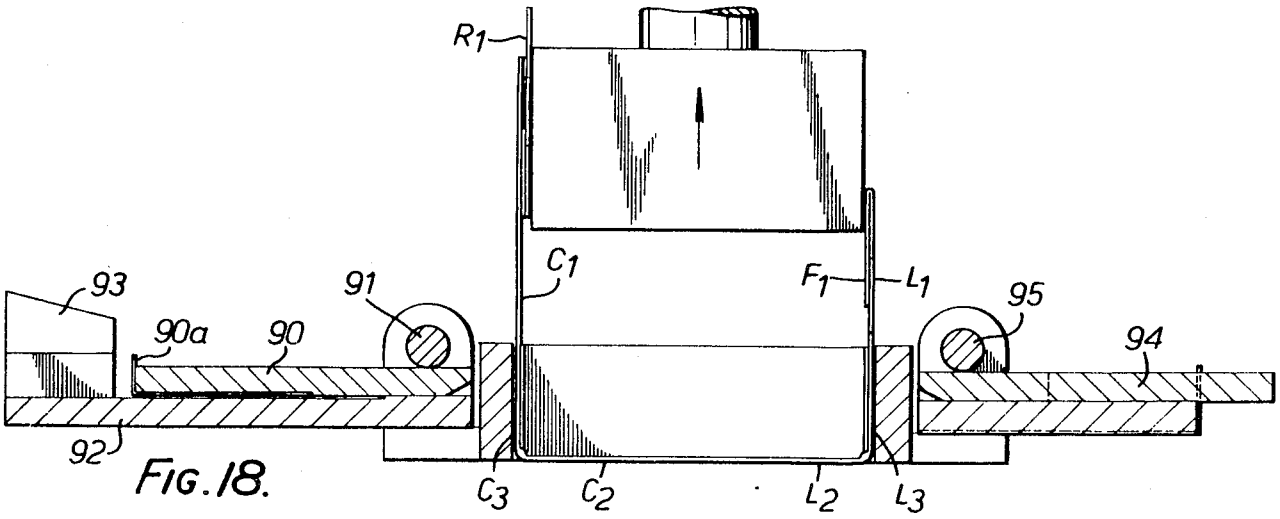
FIGS. 18 to 22 are sections through apparatus for folding down the parts of the skillet forming the front of the box, showing the positions of the parts of the apparatus and of the box at different stages of the folding operation.
Figure 19:
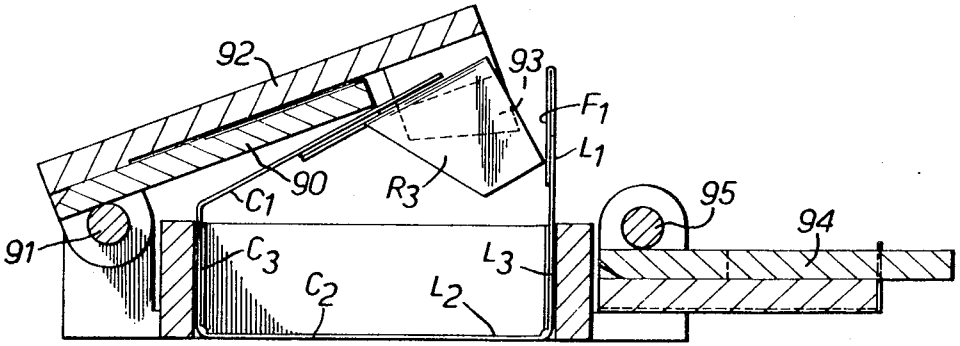
Figure 20:
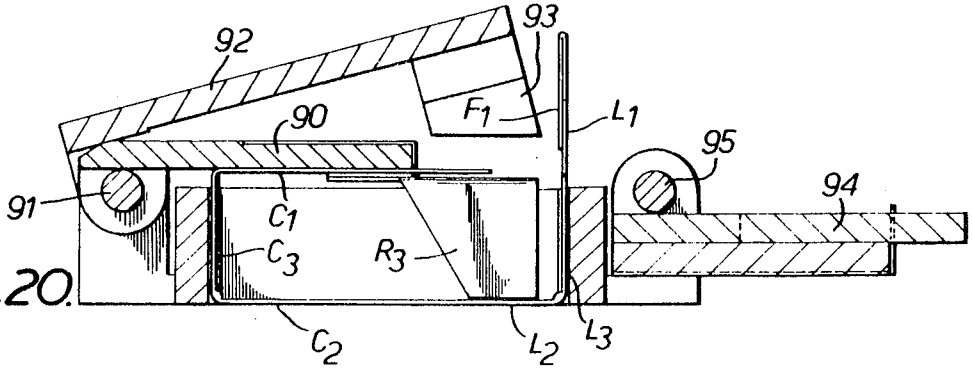
Figure 21:
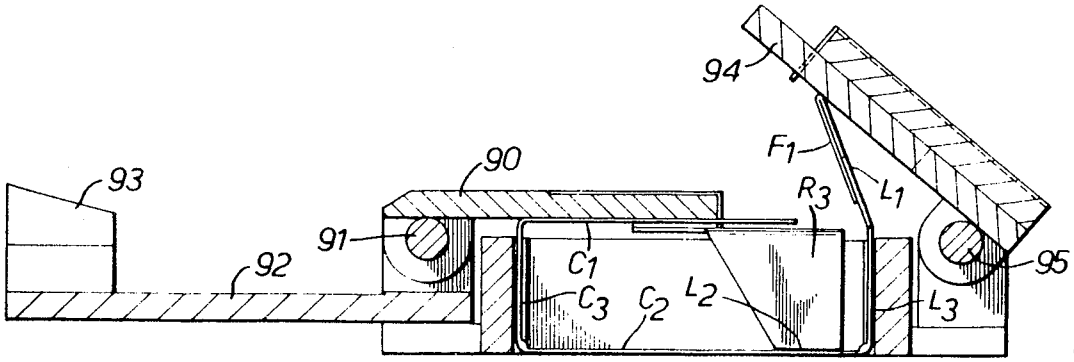

In this stage of folding, an arm 90 is arranged to swing about hinge 91 on plate 74 to swing panel $C_1$ downwardly from the position of FIG. 18 towards the position of FIG. 20 in which it is parallel to panel $C_2$.

A second arm 92 pivoted on the same hinge 91, longer than the arm 90, is provided at its outer end with parallel spaced wings 93 for engagement with the panels $R_2$ and $R_3$.

In the performance of this step, both arms 90 and 92 move from the position of FIG. 18 into an upright position as the plunger 84 is being raised, and folds the panels $R_2$ and $R_3$ against the sides of the plunger, bending them about lines 30, 31. The plunger then continues its upward movement until it is clear of the path of movement of the arms 90,92. Arm 92, still holding panels $R_2$ and $R_3$ in their inwardly folded position, swings downwardly with arm 90 through the position of FIG. 19 into position in which the panels $R_2$ and $R_3$ have been fully inserted into the die opening and on the inside of panels $C_4$ $C_5$.

The arm 90 which engages and effects the folding of panel $C_1$ is formed with a projection **90*a*** designed to pull back on the edge of panel $R_1$ so that the corners of panels $R_2$ and $R_3$ which define two corners of the skillet will be held clear of the flaps $F_2$,$F_3$ as panel $C_1$ enters its fully-folded position.

It is an important feature of the box that the corners of panels $R_2$,$R_3$ which define the corners of the skillet should fit tightly into the corners defined between the erected panel $L_6$ and flap $F_2$, and between panel $L_7$ and flap $F_3$, so that the back panel formed by $L_2$,$C_2$ is held rigidly in the closed position and thereby resists opening of the flip-top of the box.

Arm 92 is then withdrawn leaving arm 90 holding down the panel $C_1$.

Figure 22:
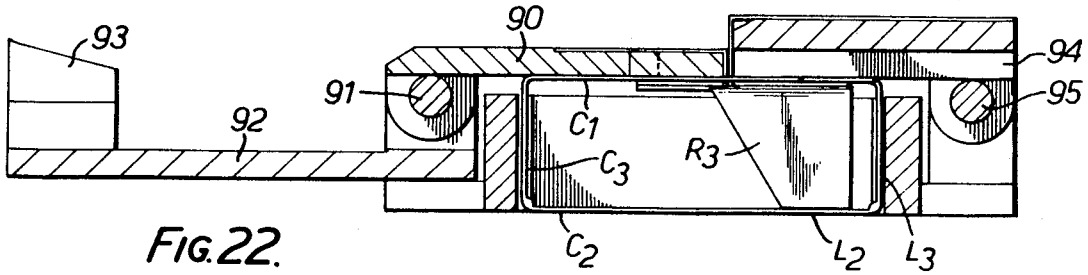

A third arm 94 hinged at 95 on the opposite sides of the die opening from hinge 91, is arranged to swing upwardly into contact with panel $L_1$ and to swing this panel downwardly into a position flush with panel $C_1$, as shown in FIG. 22.

Figure 23:
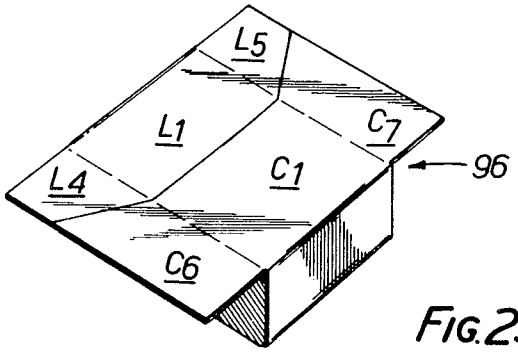
FIG. 23 is a perspective view of the box as folding in the apparatus of FIGS. 17 to 22.

At this stage of folding, the appearance of the box 96 is as shown in FIG. 23.

Figure 24:
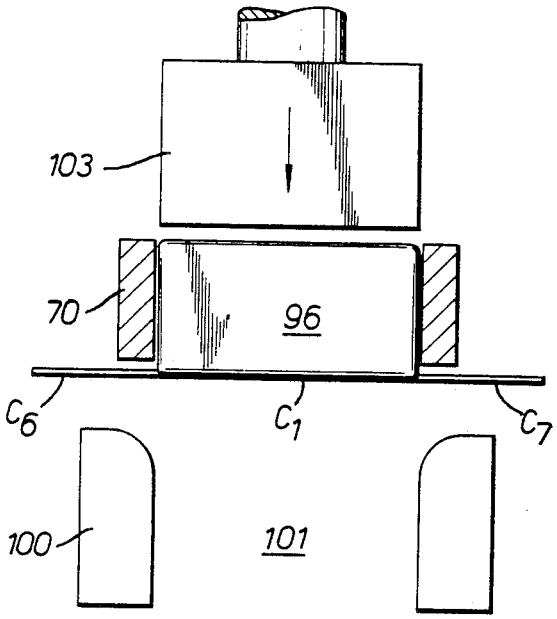
FIGS. 24 and 25 are sections through apparatus including a second die to complete the folding of the box.
Figure 25:
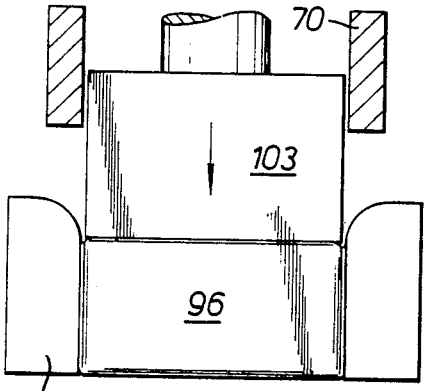
Figure 26:
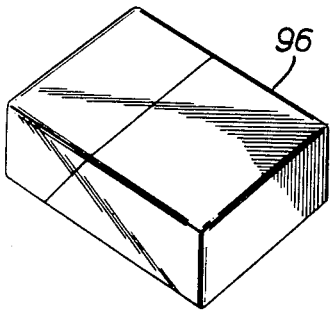
FIG. 26 is a perspective view of the completed box.

In a final stage of the folding operation as illustrated in FIGS. 24 and 25, the erecting die is bought opposite a drying die 100, the drying die having an opening 101 therein designed to fit the completed box. The drying dies are conveniently pivoted together in a continuous series to form a sixth conveyor 102 having a run extending alongside a run of the erecting die conveyor. A plunger 103 above the erecting die 70 is moved to thrust the box out of the opening of the erecting die into the opening 101 of the drying die simultaneously causing the adhesively coated panels $C_6$,$C_7$ and $L_4$,$L_5$ to be folded down against the sides of the box and be adhered thereto, to complete the box as shown in FIG. 26.

Each completed box is then ejected from its drying die on to an output conveyor not shown.

The apparatus for erecting the flip-top boxes as described above is intended to attain high speeds of production possibly as high as 400 boxes per minute.

We claim:

1. A method of folding a one-piece skillet to form a flip-top box, the skillet having crease lines to define a main panel ($C_2$, $L_2$), to form the back of the container and of the lid of the box, left and right, inside and outside panels ($C_4$, $C^5$, $C_6$, $C_7$), to form the left and right, inside and outside panels for the lid ($L_6$, $L_4$, $L_7$, $L_5$), front panel ($C_1$) and retainer panel ($R_1$) a bottom panel ($C_3$) for the container and a top panel ($L_3$)and front panel ($L_1$) for the lid, certain of the said panels having flaps attached thereto, which method if characterized by the steps of pressing the skillet in a first direction relative to said main panel into a rectangular opening of a first die shaped to die said main panel ($C_2$, $L_2$) to cause the adjacent said left and right inside panels ($C_4$, $L_6$, $C_5$, $L_7$) and top and bottom panels ($L_3$, $C_3$) attached thereto to be bent into planes perpendicular to said main panel ($C_2$, $L_2$) and thereafter, while the skillet is retained in the die opening, folding the front container panel ($C_1$) and front lid panel ($L_1$) into parallel relationship with the main panel ($C_2$, $L_2$) and, adhesive having been applied to the outside panels ($C_6$, $C_7$) of the container and ($L_4$, $L_5$) of the lid, pressing the partially-formed box from the first die in a second direction relative to said main panel, opposite said first direction of pressing, into a second die in which the said outside panels ($C_6$, $C_7$, $L_4$, $L_5$) are folded down and adhered in position to complete the closed box construction.

2. A method according to claim 1 which comprises the initial step of commencing to bend inwardly flaps ($F_2$, $F_3$, $F_4$, $F_5$) which are attached to the inside panels ($L_6$, $L_7$) of the lid and the inside panels ($C_4$, $C_5$) of the container prior to commencing to bend inwardly the inside panels ($L_6$, $L_7$) of the lid and the inside panels ($C_4$, $C_5$) of the container.

3. A method of folding a one-piece skillet to form a flip-top box, the skillet having crease lines to define a main panel ($C_2$, $L_2$), to form the back of the container and of the lid of the box, left and right, inside and outside panels ($C_4$, $C_5$, $C_6$, $C_7$), to form the left and right sides of the container, left and right, inside and outside panels for the lid ($L_6$, $L_4$, $L_7$, $L_5$), front panel ($C_1$) and retainer panel ($R_1$) a bottom panel ($C_3$) for the container and a top panel ($L_3$) and front panel ($L_1$) for the lid, certain of the said panels having flaps attached thereto, which method is characterized by the steps of the initial step of commencing to bend inwardly flaps ($F_2$, $F_3$, $F_4$, $F_5$) which are attached to the inside panels ($L_6$, $L_7$) of the lid and the inside panels ($C_4$, $C_5$) of the container pressing the skillet into a rectangular opening of a first die shaped to fit said main panel ($C_2$, $L_2$) to cause the adjacent said left and right inside panels ($C_4$, $C_6$, $C_5$, $C_7$) and top and bottom panels ($L_3$, $C_3$) attached thereto to be bent into planes perpendicular to said main panel ($C_2$, $L_2$) and thereafter, while the skillet is retained in the die opening, folding the front container panel ($C_1$) and front lid panel ($L_1$) into parallel relationship with the main panel ($C_2$, $L_2$) and, adhesive having been applied to the outside panels ($C_6$, $C_7$) of the container and ($L_4$, $L_5$) of the lid, pressing the partially-formed box from the first die into a second die in which the said outside panels ($C_6$, $C_7$, $L_4$, $L_5$) are folded down and adhered in position to complete the closed box construction, and the further steps of folding inwardly side panels ($R_2$, $R_3$) connected to the retainer panel ($R_1$) prior to folding the front panel ($C_1$) and retainer panel ($R_1$) and said left and right outside container panels ($C_6$, $C_7$) into a plane parallel spaced from the main panel ($C_2$, $L_2$), so that the side panels ($R_2$, $R_3$) of the retainer panel ($R_1$) lie inside the left and right inside container panels ($C_4$, $C_5$) said front and retainer panels ($C_1$, $R_1$) having been brought into overlapping relationship with each other in a step of the method prior to pressing the skillet into the die.

4. A method of folding a one-piece skillet to form a flip-top box, the skillet having crease lines to define a main panel ($C_2$, $L_2$), to form the back of the container and of the lid of the box, left and right, inside and outside panels ($C_4$, $C_5$, $C_6$, $C_7$), to form the left and right sides of the container, left and right, inside and outside panels for the lid ($L_6$, $L_4$, $L_7$, $L_5$), front panel ($C_1$) and retainer panel ($R_1$) a bottom panel ($C_3$) for the container and a top panel ($C_1$) and front panel ($C_1$) for the lid, certain of the said panels having flaps attached thereto which method is characterized by the steps of feeding one piece skillets from a stack to a conveyor on which the skillets are moved in a direction transverse to their length, applying adhesive to a strengthening panel ($F_1$) attached to the front lid panel ($L_1$) and to the connecting panel P and passing the ends of the skillets through folding guides in which strengthening panel ($F_1$) is folded on to and adhered to lid panel ($C_1$) and connecting panel P is folded relative to and adhered both to the front container panel ($C_1$) and retainer panel ($R_1$) pressing the skillet into a rectangular opening of a first die shaped to fit said main panel ($C_2$, $L_2$) to cause the adjacent said left and right inside panels ($C_4$, $C_6$, $C_5$, $C_7$) and top and bottom panels ($L_3$, $C_3$) attached thereto to be bent into planes perpendicular to said main panel ($C_2$, $L_2$) and thereafter, while the skillet is retained in the die opening, folding the front container panel ($C_1$) and front lid panel ($L_1$) into parallel relationship with the main panel ($C_2$, $L_2$) and , adhesive having been applied to the outside panels ($C_6$, $C_7$) of the container and ($L_4$, $L_5$) of the lid, pressing the partially-formed box from the first die into a second die in which the said outside panels ($C_6$, $C_7$, $L_4$, $L_5$) are folded down and adhered in position to complete the closed box construction.

5. A method according to claim 4 wherein the partially folded skillets are thereafter transferred to a conveyor on which a plurality of said first dies are moved sequentially, and said first dies are brought into register with a plurality of said second dies.

6. A method according to claim 4 which comprises the initial step of commencing to bend inwardly flaps ($F_2$, $F_3$, $F_4$, $F_5$) which are attached to the inside panels ($L_6$, $L_7$) of the lid and the inside panels ($C_4$, $C_5$) of the container prior to commmencing to bend inwardly the inside panels ($L_6$, $L_7$) of the lid and the inside panels ($C_4$, $C_5$) of the container.

7. A method according to claim 6 which comprises the further steps of folding inwardly side panels ($R_2$, $R_3$) connected to the retainer panel ($R_1$) prior to folding the front panel ($C_1$) and retainer panel ($R_1$) and said left and right outside container panels ($C_6$, $C_7$) into a plane parallel spaced from the main panel ($C_2$, $L_2$), so that the side panels ($R_2$, $R_3$) of the retainer panel ($R_1$) lie inside the left and right inside container panels ($C_4$, $C_5$) said front and retainer panels ($C_1$, $R_1$) having been brought into overlapping relationship with each other in a step of the method prior to pressing the skillet into the die.

8. Apparatus for folding a one-piece skillet to form a flip-top box, said apparatus comprising a first die into which the skillet can be pressed to bring parts of the skillet perpendicular to back panels of the finished container and lid of the box, means (90, 92, 94) for bending parts of the skillet which project from the die into a plane parallel to said back panel, and a second die adapted to be (100) disposed in opposition to the first die (70) and having therein a slightly larger opening than that of the first die into which the box, after partial formation in the first die, can be pressed to fold down parts of the skillet which form outside panels of the finished box, said larger opening facing the opening of the first die when said dies are disposed in opposition.

9. Apparaus for folding a one-piece skillet to form a flip-top box, said apparatus comprising a first die into which the skillet can be pressed to bring parts of the skillet perpendicular to back panels of the finished container and lid of the box, means (90, 92, 94) for bending parts of the skillet which project from the die into a plane parallel to said back panel, and a second die (100) disposed opposite the first die (70) and having therein a slightly larger opening than that of the first die into which the box, after partial formation in the first die, can be pressed to fold down parts of the skillet which form outside panels of the finished box, and further comprising a feeding device (41) for feeding skillets sequentially from a stack (45), a conveyor (50) on which skillets are transported in a direction transverse to their length, means (54, 56) for applying adhesive to selected portions of the skillets, and folding guides (57, 60, 61) for folding a strengthening panel ($F_1$) at one end of the skillet against a front lid panel ($L_1$) adjacent thereto, and for folding a connecting panel (P) relative to both a retainer panel ($R_1$) and a front container panel ($C_1$), which are interconnected by said connecting panel (P), to bring said retainer panel ($R_1$) into overlapping relationship with said front container panel ($C_1$).

10. Apparatus according to claim 9 having a conveyor formed of a plurality of first dies (70) and a conveyor formed of a plurality of second dies (100) located in juxtaposition to bring each second die into register in turn with one of said first dies.

* * * * *